US005807128A

United States Patent [19]

Sakata et al.

[11] Patent Number: 5,807,128

[45] Date of Patent: Sep. 15, 1998

[54] ELECTRICAL CONNECTOR

[75] Inventors: Tsuyoshi Sakata; Tatsuya Arai; Tsutomu Matsuo, all of Tokyo, Japan

[73] Assignee: Hirose Electric Co., Ltd., Tokyo, Japan

[21] Appl. No.: 859,337

[22] Filed: May 20, 1997

Related U.S. Application Data

[63] Continuation of Ser. No. 561,241, Nov. 21, 1995, abandoned.

[30] Foreign Application Priority Data

Dec. 9, 1994 [JP] Japan ..... 6-306238

[51] Int. Cl.[6] ..... H01R 13/54

[52] U.S. Cl. ..... 439/326

[58] Field of Search ..... 439/326–329, 439/629–637

[56] References Cited

U.S. PATENT DOCUMENTS

| | | | |
|---|---|---|---|
| 4,984,996 | 1/1991 | Watanabe et al. | 439/326 |
| 4,998,890 | 3/1991 | Tuan | 439/326 |
| 5,064,381 | 11/1991 | Lin | 439/326 |
| 5,147,214 | 9/1992 | Korsunsky et al. | 439/326 |
| 5,199,895 | 4/1993 | Chang | 439/636 |

*Primary Examiner*—Hien Vu
*Attorney, Agent, or Firm*—Kanesaka & Takeuchi

[57] ABSTRACT

An electrical connector for connecting a daughter board to a mother board includes an insulating housing to be mounted on the mother board; a plurality of contact terminals disposed in the insulating housing; an open mouth provided in the insulating housing for receiving and allowing the daughter board to be turned toward a latch a pair of latch levers provided on opposite sides of the open mouth and having a latch portion and a sliding member at an upper portion thereof; a protective member provided on the insulation housing and spaced from the sliding member by a predetermined distance; a front surface of the latch portion being made in such a form that the daughter board can pass over the latch portions, with opposite sides thereof pushing the latch levers outwardly, when it is turned rearwardly about the edge portion; and a rear surface of the latch portion being made in such a form that it latches the daughter board to the electrical connector when the daughter board is connected to the electrical connector but it permits the latch lever reflects and the sliding member to abut against the protective member thereby pushing the latch levers outwardly to permit the daughter board to pass over the latch portion.

3 Claims, 7 Drawing Sheets

ELECTRICAL CONNECTOR

This application is a continuation of application Ser. No. 08/561,241, filed Nov. 21, 1995, now abandoned.

BACKGROUND OF THE INVENTION

1. Field of the Invention

The present invention relates to electrical connectors for connecting to a mother board a daughter board having a number of pads on an edge portion thereof in a direction vertical, parallel, or diagonal to the mother board.

2. Description of the Related Art

As the number of memories mounted on a PC board increases, more memory modules are used than ever before. Connectors for such a PC board are required to be in a low profile. To meet such a requirement, zero insertion force connectors have been used.

Such zero insertion force connectors have latch levers with a latch portion erected on opposite sides of an open mouth in the insulation housing. To connect a daughter board to the connector, the front edge portion of a daughter board is inserted into the open mouth of the front insulation housing and then turned rearwardly about the edge. Then, the latch levers are flexed outwardly by the daughter board so that the opposite sides of the daughter board pass over the latch portions. The latch levers then snap back so that the latch portions hold the respective sides of the daughter board. This complete the connection of the daughter board to the electrical connector.

The daughter board connected to the electrical connector is biased to turn forwardly by the contact terminals disposed in the open mouth of the insulation housing. To prevent this forward rotation, the latch portions of the latch levers hold the daughter board on the front surface of the opposite sides. Consequently, unless the latch levers are flexed outwardly, the daughter board cannot be removed from the electrical connector.

However, if a large external force is applied to the daughter board tending to turn forwardly, the latch portions or latch lever and/or the daughter board can be broken.

SUMMARY OF THE INVENTION

Accordingly, it is an object of the invention to provide an electrical connector free from the above problems.

According to the invention there is provided an electrical connector for connecting a daughter board with a plurality of pads on an edge portion thereof to a mother board, which includes an insulating housing to be mounted on the mother board; a plurality of contact terminals disposed in the insulating housing; an open mouth provided in the insulating housing for receiving and allowing the daughter board to be turned toward a latch position; the contact terminals arranged in the open mouth in a lengthwise direction of the open mouth; a pair of latch levers provided on opposite sides of the open mouth and having a latch portion and a sliding member at an upper portion thereof; a protective member provided on the insulation housing and spaced from the sliding member by a predetermined distance; a front surface of the latch portion being made in such a form that the daughter board can pass over the latch portions, with opposite sides thereof pushing the latch levers outwardly, when it is turned rearwardly about the edge portion; and a rear surface of the latch portion being made in such a form that it latches the daughter board to the electrical connector when the daughter board is connected to the electrical connector but it permits the latch lever reflects and the sliding member to abut against the protective member thereby pushing the latch levers outwardly to permit the daughter board to pass over the latch portion.

According to a preferred embodiment of the invention, the sliding members are sliding projections and the protective member are U-shaped structures to provide protective walls facing to the sliding members.

According to another preferred embodiment of the invention, the sliding members are over flexure preventing projections and the protective members are second over flexure preventing projections between the first over flexure preventing projection and the daughter board.

According to still another preferred embodiment of the invention, the rear face of the patch portion is made up of upper and lower inclined surfaces having different angles, with the upper surface having an angle more obtuse than that of the lower surface.

The above and other objects, features, and advantages of the invention will be more apparent from the following description when taken in conjunction with the accompanying drawings.

DESCRIPTION OF THE PREFERRED EMBODIMENT

Figure 1:
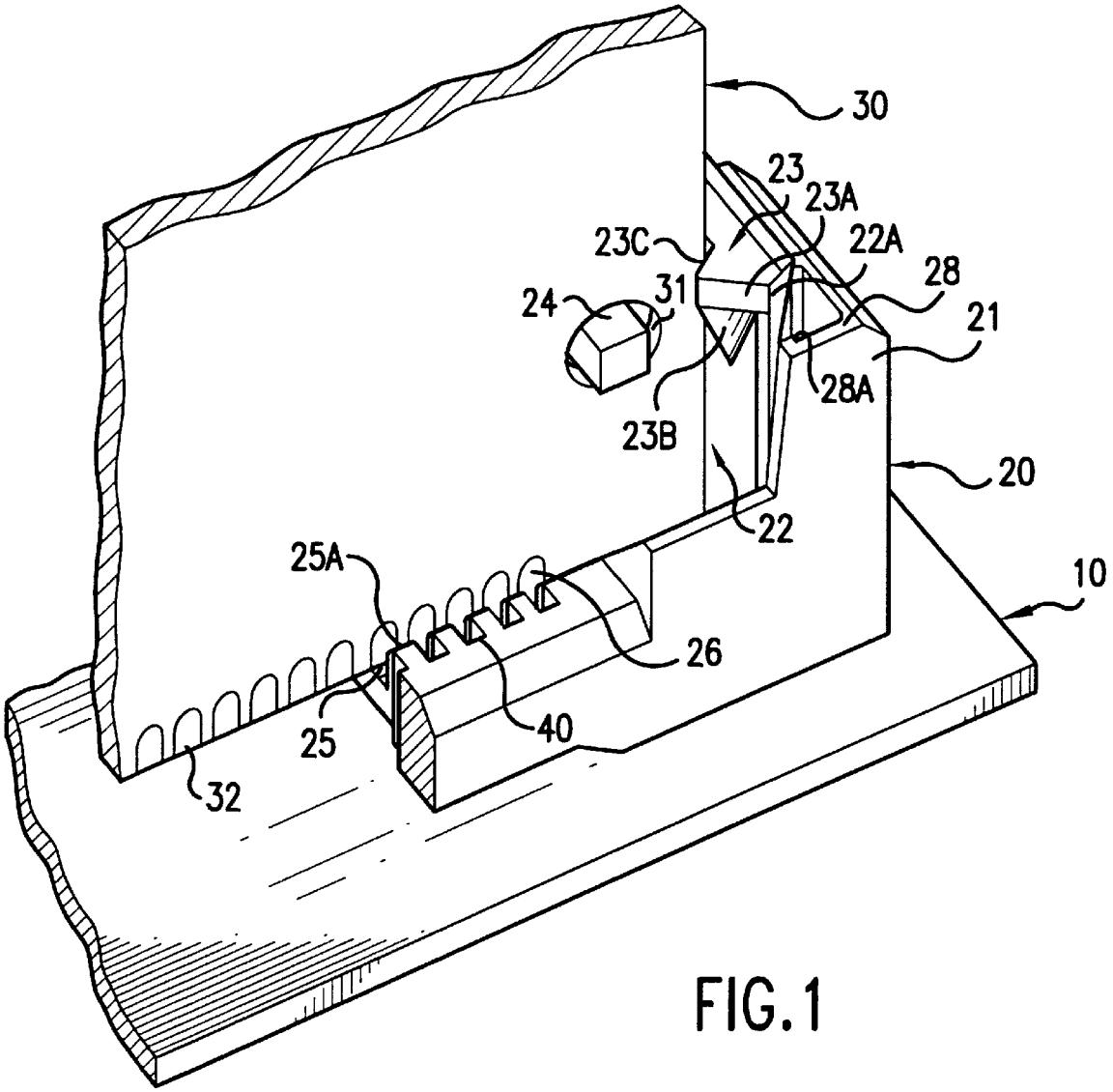
FIG. 1 is a perspective view of part of an electrical connector according to an embodiment of the invention.

In FIG. 1, an electrical connector 20 according to an embodiment of the invention includes an insulation housing 21 mounted on a mother board 10. An open mouth 25 extends in the bottom of and in a lengthwise direction of the insulation housing 21. A daughter board 30 having memory modules therein is inserted into the open mouth 25 in a diagonal direction and then turned to the right angles to the mother board.

A number of common pads 32 are arranged at regular intervals on the both sides of a front edge of the daughter board 30. These common pads 32 are electrically connected to various components, such as memories, on the daughter board 30 via conductor patterns (not shown). Such a daughter board is conventional and will not be described in detail.

A number of terminal receiving slots 26 are provided in front, bottom and rear walls of the mouth 25. These terminal receiving slots 26 are arranged at regular intervals that are equal to those of the pads 32. A number of contact terminals 40 are disposed in the respective terminal receiving slots 26.

A pair of latch levers 22 extend upwardly from opposite ends of the mouth 25 in the insulation housing 21 and have a latch portion 23 at the top. A projection 24 is provided on a rear wall of the insulation housing 21 near the latch lever 22 for engagement with a hole 31 of the daughter board thereby preventing the daughter board 30 from escaping upwardly.

To connect the daughter board 30 to the electrical connector 20 on the mother board 10, a front edge portion of the daughter board 30 is diagonally inserted into the mouth 25 and then turned rearwardly about the edge. The opposite sides of the daughter board 30 push outwardly the cam faces of the latch portions 23 of the latch lever 22. When the daughter board 30 passes the latch portions 23, the engaging holes 31 engage the projections 24 while the latch levers 22 snap to hold the daughter board 30, thus completing connection of the daughter board 30 to the electrical connector 20 as shown in FIG. 1.

To remove the daughter board 30, the latch levers 22 are flexed outwardly so that the daughter board 30 is turned forwardly over the latch portions 23 by spring forces of the contact terminals 40, thus permitting removal of the daughter board from the mouth 25.

Figure 2:
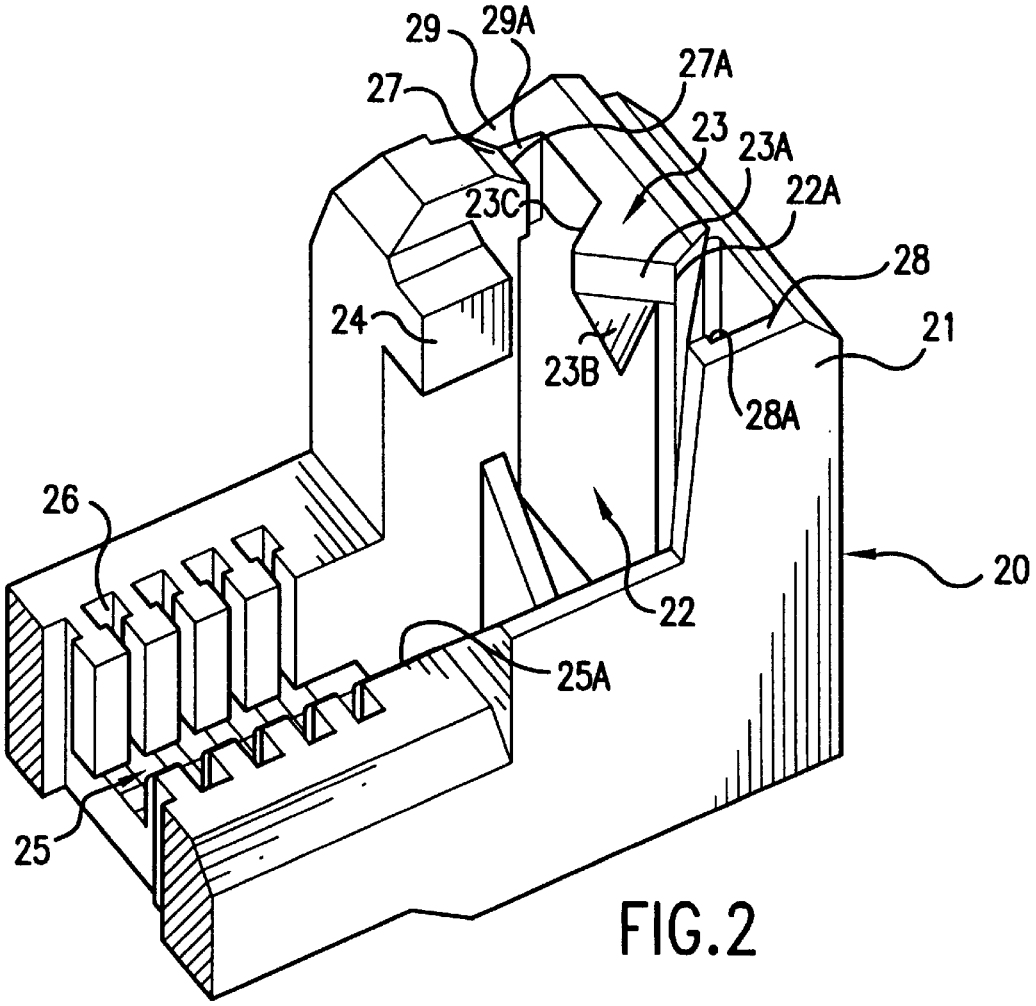
FIG. 2 is a perspective view of part of an insulation housing for the electrical connector.

In FIG. 2, latch levers 22 extend upwardly from opposite ends of the open mouth 25 in the insulation housing 21. The latch levers 22 are integrally molded with the insulation housing 21 from a plastic material. Free ends of the latch levers 22 are flexible outwardly, with the joint between the latch levers and the bottom of the insulation housing 21 as a fulcrum.

Figure 3:
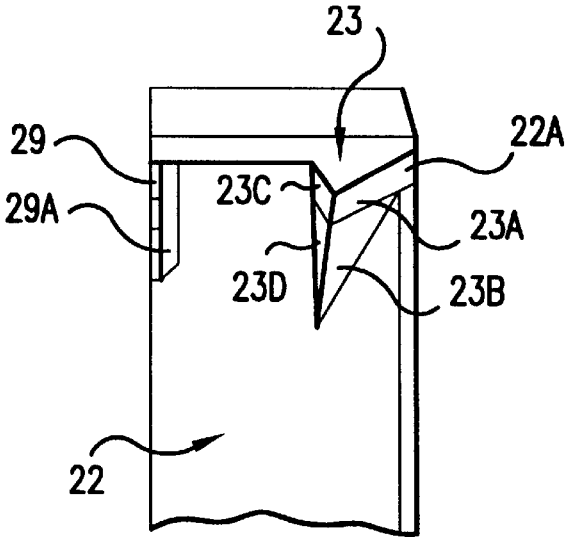
FIG. 3 is a side view of an upper portion of a latch lever provided in the insulation housing.

A latch portion 23 extends inwardly from the upper inner surface of each latch lever 23. An over flexure preventing projection 29 is provided behind the latch portion 23. As shown in FIGS. 2 and 3, the front face of the latch portion 23 consists of two abutting surfaces 23A and 12B having different sloping angles with respect to the daughter board. As best shown in FIG. 3, the rear face of the latch portion 23 consists of two abutting surfaces 23C and 23D having different sloping angles with respect to the daughter board. The sloping angles of the abutting surfaces 23C and 23D are made more acute than those of the abutting surfaces 23A and 23B. The angle of the abutting surface 23A is made more obtuse than that of the abutting surface 23B while the angle of the abutting surface 23C is made more obtuse than that of the abutting surface 23D. The front surface 29A of the over flexure preventing projection 29 is inclined slightly. A sliding projection 22A is provided on the upper front side of the latch lever 23.

Figure 4:
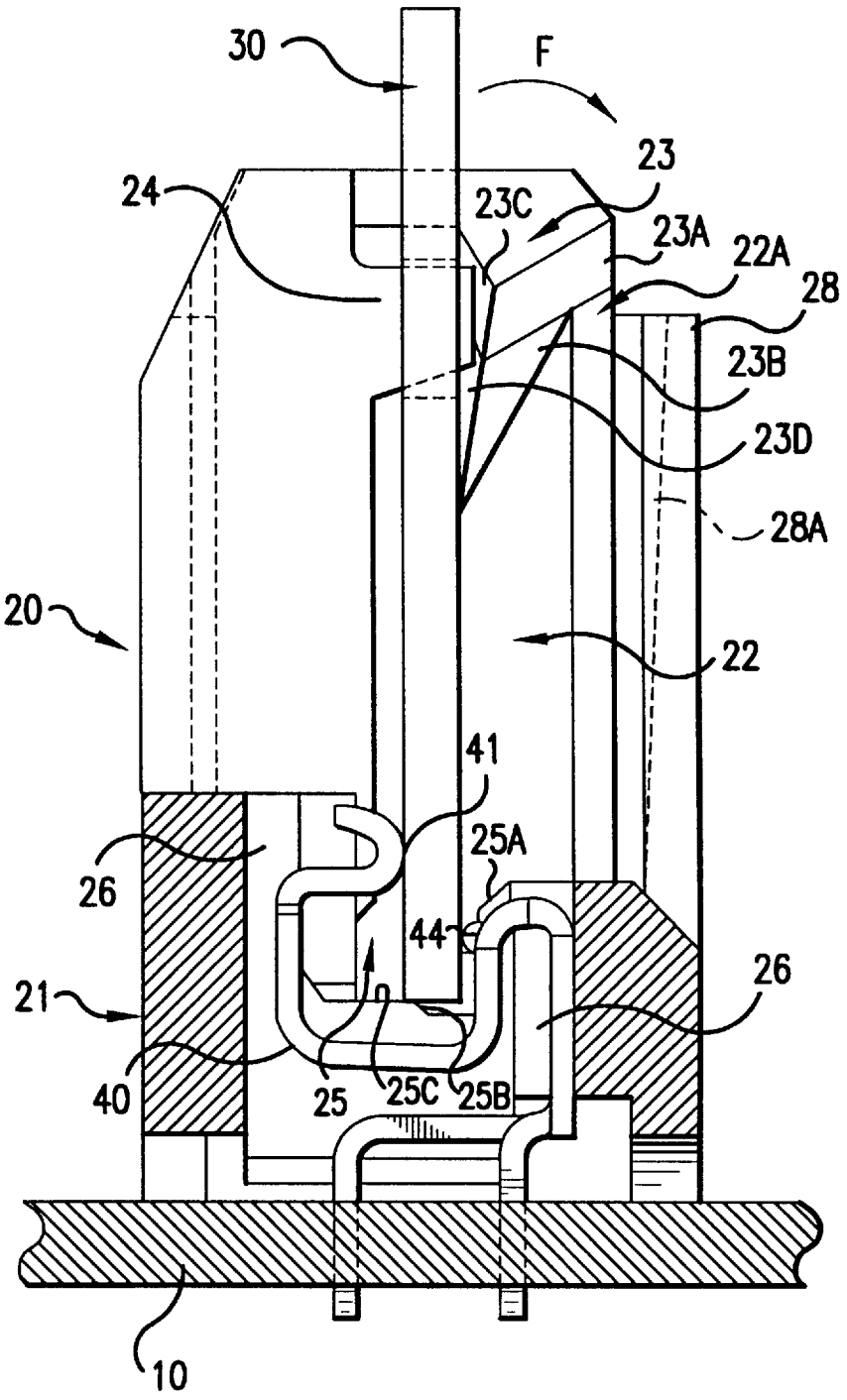
FIG. 4 is a sectional view of the electrical connector mounted on a mother board, to which a daughter board is connected.
Figure 5:
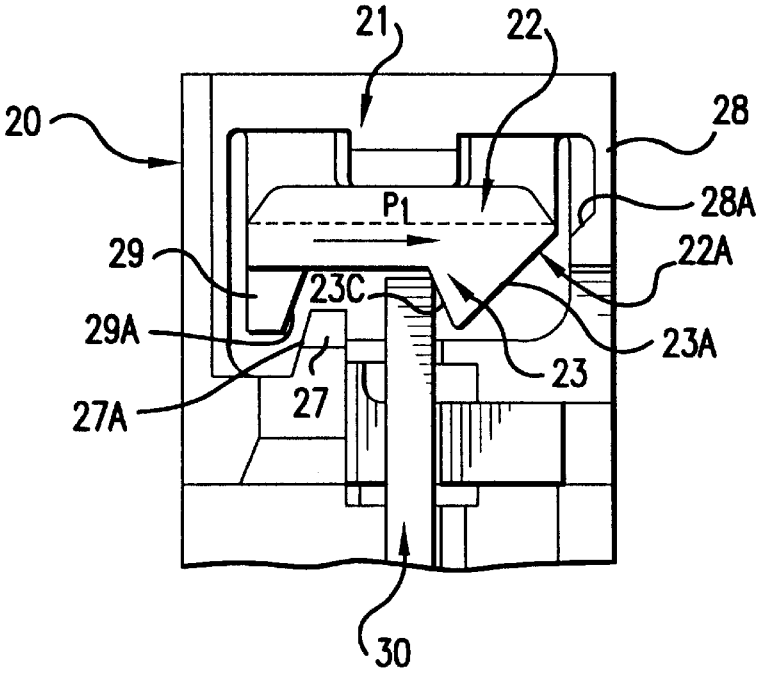
FIG. 5 is a top plan view of a latch portion of the electrical connector.

A U-shaped member 28 is integrally molded with the insulation housing 21 so as to provide a protective wall 28A facing the sliding projection 22A which has a different sloping angle with respect to the major face of the latch lever 22. As shown in FIGS. 4 and 5, the protective wall 28A is inclined at an angle corresponding to that of the sliding projection 22A. In FIG. 2, a projection 24 is provided on the inner rear face of the latch lever 22. An over flexure preventing projection 27 is provided at a position corresponding to the over flexure preventing projection 29. The rear face 27A of the over flexure preventing projection 27 is inclined slightly.

In FIGS. 4 and 5, to connect the daughter board 30 to the electrical connector 20, the front edge portion of the daughter board 30 is inserted in the open mouth 25 of the insulation housing 21 by sliding it along the inclined guiding edge 25A of the open mouth 25. The distance between the upper contact points 41 and the lower contact points 44 of contact terminals 40 are made equal to or slightly larger than the thickness of the edge portion of the daughter board 30 so that there is almost no resistance to the daughter board 30 by the contact elements 40, permitting zero force insertion of the daughter board 30 in the open mouth 25.

When the front end of the daughter board 30 strikes the inclined surface 25B on the bottom of the open mouth 25, the daughter board 30 is turned rearwardly (to the left in FIG. 4) at a point between the daughter board the inclined surface 25B. When the daughter board 30 is turned rearwardly against the spring forces of the flexed contact elements 40, the daughter board 30 abuts against the front surfaces 23A and 23B of the latch portion 23. Consequently, the latch levers 22 are flexed outwardly by the cam action of the inclined front surfaces 23A and 23B, permitting the daughter board 30 to pass over the latch portions 23.

The engaging holes 31 of the daughter board 30 engage with the projections 24 of the insulation housing 21 while the latch lever 22 snap the daughter board 30 as shown in FIGS. 4 and 5. Under such a latch condition, the daughter board 30 is latched to the electrical connector 20, with the lower end of the daughter board 30 resting on the flat surface 25C of the bottom of the open mouth 25 while the common pads 32 being held between the upper contact points 41 and the lower contact points 44 with a predetermined contact force resulting from the spring forces of the contact terminals 40.

Under the latched condition, the daughter board 30 is biased forwardly (to the right in FIG. 4) by the contact terminals 40. However, the daughter board 30 is held by the latch portions 23 and not turned forwardly. The inside angles of the inclined surfaces 23C and 23D of the latch portions 23 are made almost as large as right angles so that the latch levers 22 are not moved outwardly (a direction perpendicular to the sheet) by the daughter board 30 which is biased forwardly by the contact terminals 40.

When an external force F is applied to the daughter board tending to turn the daughter board 30 forwardly as shown in FIG. 4, the latch levers 22 are flexed forwardly as shown by an arrow P1 in FIG. 5 because the opposite sides of the board are held by the steep rear surfaces 23D of the latch portions 23.

Figure 7:
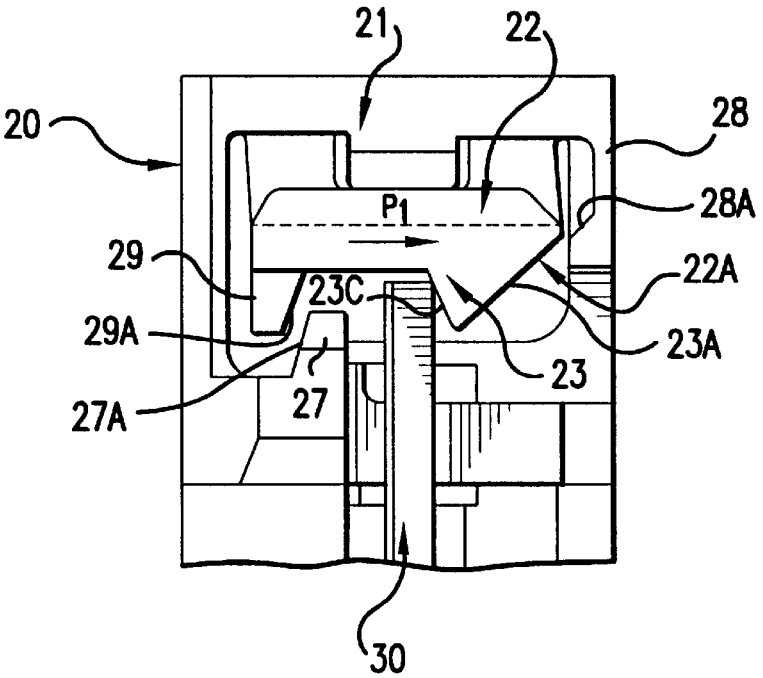
FIG. 7 is a top plan view of the latch portion when a large external force is applied to the daughter board to flex the latch lever forwardly.
Figure 6:
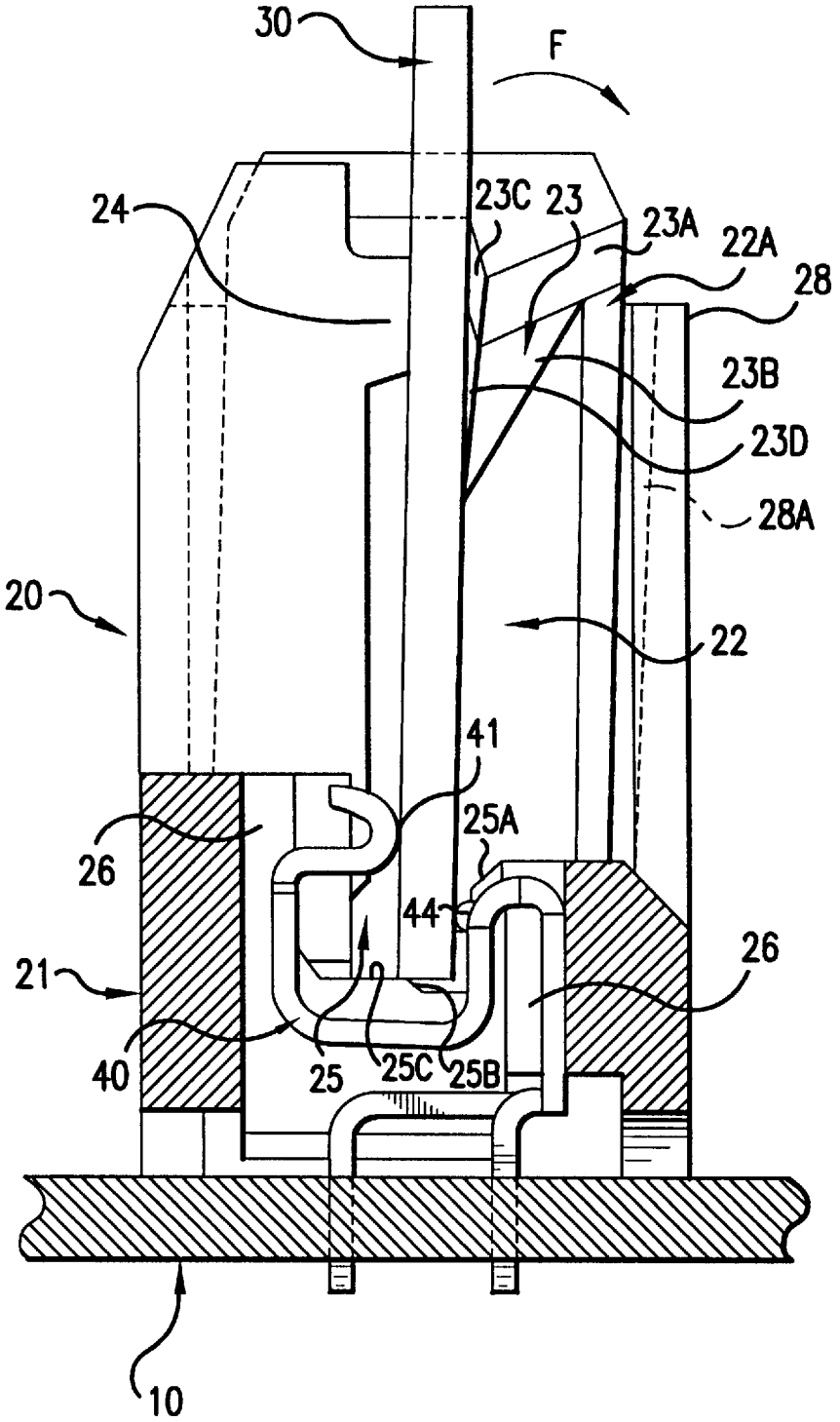
FIG. 6 is a sectional view of the electrical connector wherein a large external force is applied to the daughter board so that the latch lever is flexed forwardly.

In FIGS. 6 and 7, the external force F is so large that the sliding projections 22A of the latch levers 22 and the inclined surface 29A of the over flexure preventing projection 29 are brought to such positions that they are very close to the protective walls 28A of the U-shaped member 28 and the inclined surface 27A of the over flexure preventing projections 27, respectively (see FIG. 7). Since the latch levers 22 are flexed only forwardly as shown by the arrow P1, the opposite sides of the daughter board 30 are held firmly by the rear surfaces 23D of the latch portions 23. Consequently, the opposite sides of the daughter board 30 do not pass over the latch portions 23 so that the daughter board 30 does not come off from the open mouth 25. When the external force is removed from the daughter board 30, the latch levers 22 return to the original latch positions as shown in FIGS. 4 and 5.

Figure 8:
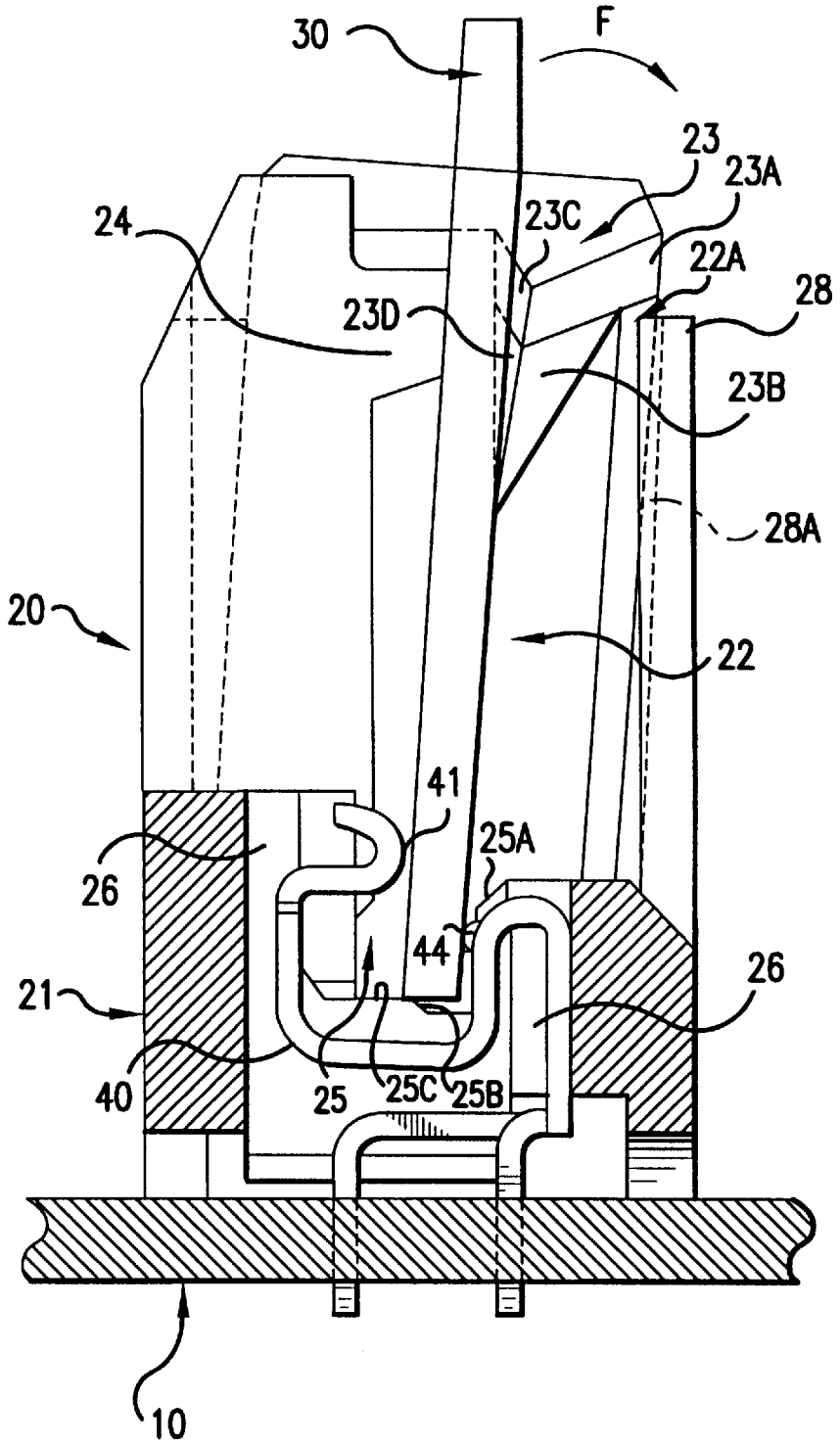
FIG. 8 is a sectional view of the electrical connector wherein a very large external force is applied to the daughter board to release the latch.
Figure 9:
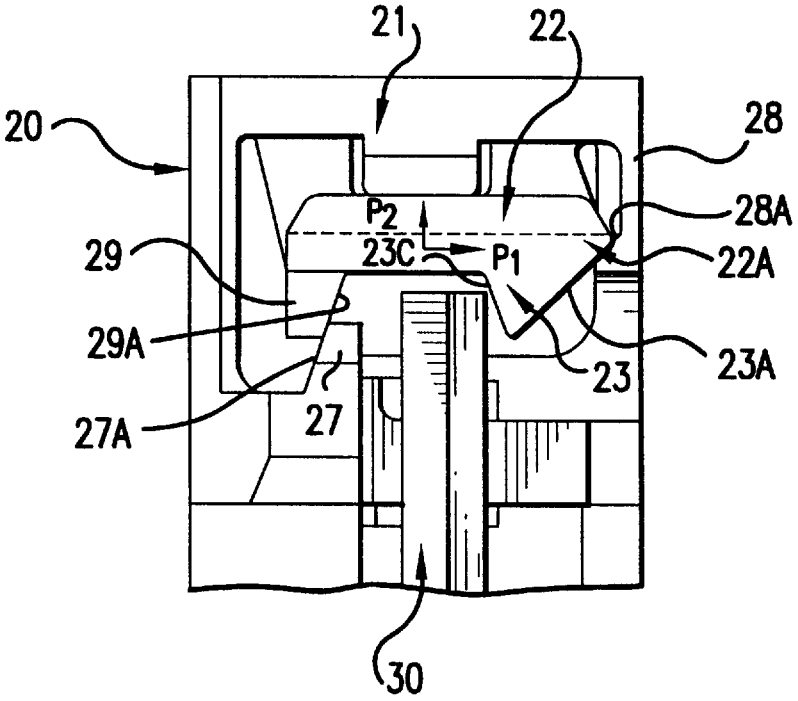
FIG. 9 is a top plan view of the latch portion wherein a very large external force is applied to the daughter board to release the latch.

In FIGS. 8 and 9, if the external force F is very large, the latch levers 22 are flexed in the direction of arrow P1 (FIG. 9) so that the sliding projections 22A of the latch levers 22 are brought to such a position as to abut the protective walls 28A of the U-shaped member 28. When the sliding projections 22A abut the protective walls 28A of the U-shaped member 28, the latch levers 22 are flexed outwardly as shown by an arrow P2 by the cam action. Consequently, the apparent angles of the inclined surfaces 23D with respect to the daughter board 30 decreases so that the opposite sides of the daughter board 30 slide on the rear surfaces 23D thereby further moving the latch levers 22 in the direction of arrow P2. Similarly, when the latch levers 22 are flexed in the direction of arrow P1 so that the front surfaces 29A of the over flexure preventing projections 29 are brought to such a position as to abut the rear surface 27A of the over flexure prevent projections 27, the latch levers 22 are subjected to a cam action of the abutted inclined surfaces.

As described above, when the external force F is very large, the daughter board 30 is moved forwardly. The positions where the daughter board 30 is held by the latch levers 22 are moved from the rear surfaces 23D to the rear surfaces 23C as the daughter board 30 is turned forwardly. The rear surfaces 23C are made less steep than the rear surfaces 23D, making it easier for the daughter board 30 to slide on the rear surface 23C, providing a cam action to push the latch levers 22 outwardly in the direction of arrow P2.

If an excessive external force is applied to the daughter board 30, the opposite sides of the daughter board 30 readily pass over the latch portions 23 of the latch levers 22 by the cam action, so as to prevent the latch levers 22 from being flexed too much in a forward direction and broken or, otherwise, the latch portions 23 and/or the daughter board 30 from being broken. After the daughter board 30 passes over the latch portions 23, the latch levers 22 return to the erected position while the daughter board 30 is ready to be removed from the open mouth 25 with zero removal force.

The front face of the latch portion 23 made up of two inclined surfaces 23A and 23B having different inclination angles and the rear face of the latch portion 23 made up of two inclined surfaces 23C and 23D having different inclination angles facilitate passing of the daughter board 30 over the latch portions 23 upon plugging on and off of the daughter board 30. Alternatively, only one of the two combinations between (1) the sliding projections 22A and the protective wall 28A and (2) the inclined surface 29A of the over flexure preventive projection 29 and the inclined surface 27A of the over flexure preventing projections 27 may be employed.

The present invention is also applicable to electrical connectors by which a daughter board is connected to a mother board at an angle other than right angles. For example, a daughter board may be connected to a mother board in a parallel direction.

With the latch structure according to the invention, it is possible to protect the latch condition if an external force is applied to the daughter board which has been latched to the electrical connector. If such an external force is excessive, the latch condition is released to let the excessive external force to go thereby preventing damage to the latch portions, the daughter board, and/or latch levers.

What is claimed is:

1. An electrical connector for connecting a mother board to a daughter board having a plurality of pads on a front edge portion thereof, said connector comprising:

an insulating housing (20) to be mounted on said mother board;

a plurality of contact terminals (40) disposed in said insulating housing;

an elongated open mouth (25) provided in said insulating housing for receiving said daughter board which is then turned in a first direction toward a latch position;

said contact terminals arranged in said open mouth in a longitudinal direction of said open mouth;

a pair of latch levers (22) provided on opposite sides of said open mouth and having latch portions (23) at upper portions of said latch levers;

at least one of first sliding angle means (22A) and second sliding angle means (29A) provided on said latch levers;

at least one of first protective members (28) and second protective member (27) provided on said insulation housing in vicinity of said first or second sliding angle means with a predetermined distance;

front surfaces of said latch portions being inclined such that said daughter board can pass said latch portions when it is turned from said first direction to said latch position;

rear surfaces of said latch portions being inclined such that said latch portions latch said daughter board to said electrical connector when said daughter board is turned to said latch position; and at least one of combinations between said first sliding angle means (22A) and said first protective member (28) and between said second sliding angle means (27) having a pair of inclined surface (22A and 28A) or (29A and 27A) such that if an excessive force is applied to said daughter board in a second direction which is opposite to said first direction, said latch levers flex in said second direction so that said first or second sliding angle means abut against said first or second protective members so as to flex said latch levers outwardly in said longitudinal direction to permit said daughter board to pass said latch portions thereby preventing damage to said latch levers and daughter board, wherein said protective members (28) have U-shaped structures to provide protective walls (28A) in front of said sliding angle means (22A).

2. An electrical connector according to claim 1, wherein said second sliding angle means (29) have first over flexure preventing projections (29) and said second protective members 27 have second over flexure preventing projections (27) located in front of said first over flexure preventing projection and behind said daughter board.

3. An electrical connector according to claim 1, wherein said rear surfaces of said latch portions have upper and lower inclined surfaces (23C, 23D) having different angles, with said upper surface being less steep than said lower surface.

* * * * *